United States Patent [19]

Donaghy et al.

[11] 4,284,660

[45] Aug. 18, 1981

[54] ELECTROLESS DEPOSITION PROCESS FOR ZIRCONIUM AND ZIRCONIUM ALLOYS

[75] Inventors: Robert E. Donaghy; Anna H. Sherman, both of Wilmington, N.C.

[73] Assignee: General Electric Company, San Jose, Calif.

[21] Appl. No.: 904,783

[22] Filed: May 11, 1978

[51] Int. Cl.[3] ..... B05D 3/12

[52] U.S. Cl. ..... 427/57; 427/235; 427/239; 427/309; 427/315; 427/333; 427/353; 427/355; 427/405; 427/419.2; 427/437; 427/438

[58] Field of Search ..... 427/57, 5, 6, 309, 430 A, 427/405, 419 A, 235, 239, 333, 353, 355, 315, 319, 419.2, 437, 438; 156/638, 664

[56] References Cited

U.S. PATENT DOCUMENTS

| | | | |
|---|---|---|---|
| 2,809,127 | 10/1957 | Gibson | 427/405 |
| 2,961,337 | 11/1960 | Bryant et al. | 427/405 |
| 3,974,322 | 8/1976 | Drabkina et al. | 427/5 |
| 4,029,545 | 6/1977 | Gordon et al. | 176/82 |
| 4,128,691 | 12/1978 | Shirahata et al. | 428/336 |

*Primary Examiner*—Bernard D. Pianalto

*Attorney, Agent, or Firm*—Ivor J. James, Jr.; Raymond G. Simkins; Samuel E. Turner

[57] ABSTRACT

A method is disclosed for preventing stress corrosion cracking or metal embrittlement of a zirconium or zirconium alloy container that is to be coated on the inside surface with a layer of a metal such as copper, a copper alloy, nickel, or iron and used for holding nuclear fuel material as a nuclear fuel element. The zirconium material is etched in an etchant solution, desmutted mechanically or ultrasonically, oxidized to form an oxide coating on the zirconium, cleaned in an aqueous alkaline cleaning solution, activated for electroless deposition of a metal layer and contacted with an electroless metal plating solution. This method provides a boundary layer of zirconium oxide between the zirconium container and the metal layer.

15 Claims, 1 Drawing Figure

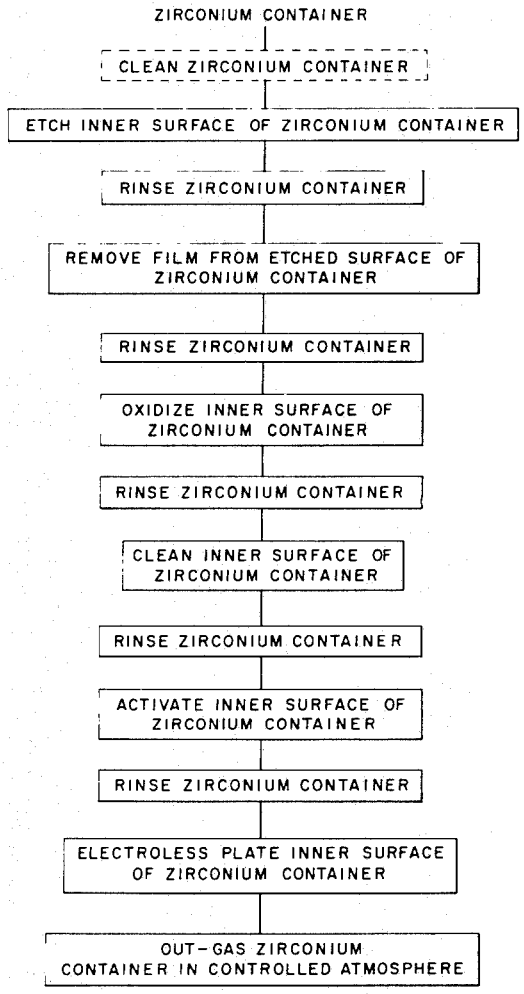

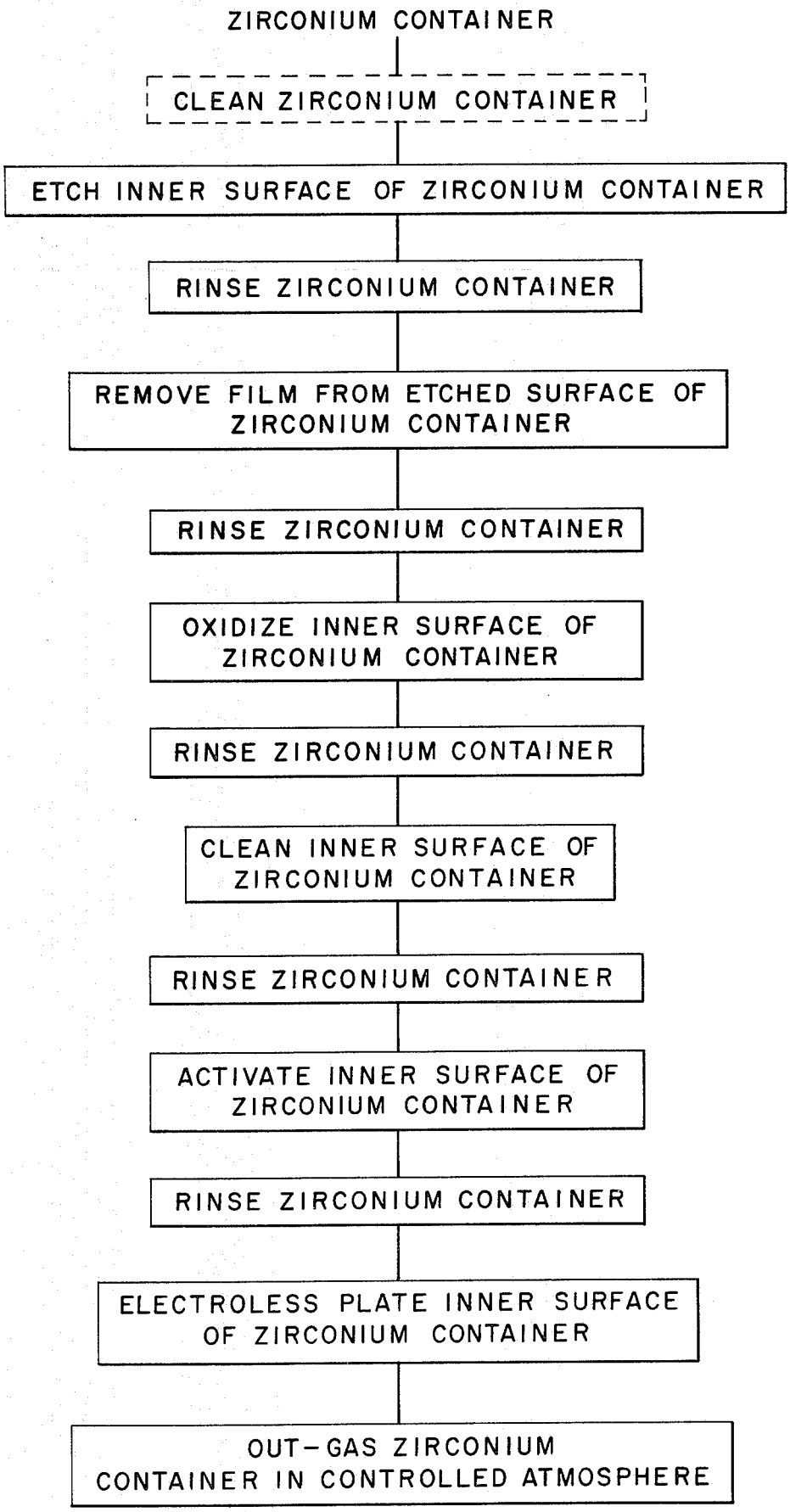
ZIRCONIUM CONTAINER
CLEAN ZIRCONIUM CONTAINER
ETCH INNER SURFACE OF ZIRCONIUM CONTAINER
RINSE ZIRCONIUM CONTAINER
REMOVE FILM FROM ETCHED SURFACE OF ZIRCONIUM CONTAINER
RINSE ZIRCONIUM CONTAINER
OXIDIZE INNER SURFACE OF ZIRCONIUM CONTAINER
RINSE ZIRCONIUM CONTAINER
CLEAN INNER SURFACE OF ZIRCONIUM CONTAINER
RINSE ZIRCONIUM CONTAINER
ACTIVATE INNER SURFACE OF ZIRCONIUM CONTAINER
RINSE ZIRCONIUM CONTAINER
ELECTROLESS PLATE INNER SURFACE OF ZIRCONIUM CONTAINER
OUT-GAS ZIRCONIUM CONTAINER IN CONTROLLED ATMOSPHERE

ELECTROLESS DEPOSITION PROCESS FOR ZIRCONIUM AND ZIRCONIUM ALLOYS

The Government has rights in this invention pursuant to Subcontract No. 3-20-46 under Prime Contract EN-77-C-02-4473 awarded by the U.S. Department of Energy.

BACKGROUND OF THE INVENTION

This invention relates broadly to nuclear fuel elements for use in the core of nuclear fission reactors. More particularly, the present invention relates to a method for making a zirconium containing composite cladding for nuclear fuel having a metal coating on its inner surface in proximity to the fuel and an intermediate zirconium oxide boundary layer.

Nuclear reactors are presently being designed, constructed and operated in which the nuclear fuel is contained in fuel elements which can have various geometric shapes, such as plates, tubes, or rods. The fuel material is usually enclosed in a low neutron absorbing corrosion-resistant, non-reactive, heat conductive container or cladding. The fuel elements are assembled together in a lattice at fixed distances from each other in a coolant flow channel or region forming a fuel assembly, and sufficient fuel assemblies are combined to form the nuclear fission chain reacting assembly or reactor core capable of a self-sustained fission reaction, The core in turn is enclosed within a reactor vessel through which a coolant is passed. The cladding serves several purposes and two primary purposes are: first, to prevent contact and chemical reactions between the nuclear fuel and the coolant or the moderator if a moderator is present, or both if both the coolant and the moderator are present; and second, to prevent the radioactive fission products, some of which are gases, from being released from the fuel into the coolant or the moderator or both if both the coolant and the moderator are present. Common cladding materials are steel and its alloys, zirconium and its alloys, niobium (columbium) and its alloys, and the like. The failure of the cladding, i.e., a loss of the leak tightness, can contaminate the coolant or moderator and the associated systems with radioactive fission products to a degree which interferes with plant operation.

Problems have been encountered in the manufacture and in the operation of nuclear fuel elements which employ certain metals and alloys as the clad material due to mechanical or chemical reactions of these cladding materials under certain circumstances. Zirconium and its alloys, under normal circumstances, are excellent nuclear fuel claddings since they have low neutron absorption cross sections, are strong, ductile, extremely stable, and at temperatures below about 750° F. (about 398° C.), are non-reactive in the presence of demineralized water and/or steam which are commonly used as reactor coolants and moderators.

However, fuel element performance has revealed a problem with mechanical interactions between the nuclear fuel and the cladding in the presence of certain fission products produced by nuclear fission reactions. It has been discovered that this undesirable performance is promoted by localization of mechanical stresses (due to fuel-cladding differential expansion) at cracks and at pellet-to-pellet interfaces in the nuclear fuel. Corrosive fission products are released from the nuclear fuel and are present at pellet-to-pellet interfaces and at the intersection of fuel cracks with the cladding surface. Fission products are created in the nuclear fuel during the fission chain reaction during operation of the nuclear reactor. The localized stress is exaggerated by high friction between the fuel and the cladding.

An approach to fuel design has been to coat the nuclear fuel material with a ceramic to prevent moisture coming in contact with the nuclear fuel material as disclosed in U.S. Pat. No. 3,108,936. U.S. Pat. No. 3,085,059 discloses a fuel element including a metal casing containing one or more pellets of fissionable ceramic material and a layer of vitreous material bonded to the ceramic pellets. Thus, the layer is provided between the casing and the nuclear fuel to assure uniformly good heat conduction from the pellets to the casing. U.S. Pat. No. 2,873,238 describes jacketed fissionable slugs of uranium canned in a metal case and having zinc-aluminum bonding layers as protective jackets or coverings between the slugs and the case. U.S. Pat. No. 2,849,387 discloses jacketed body sections of nuclear fuel which have been dipped into a molten bath of a bonding material giving an effective thermally conductive bond between the uranium body sections and the container (or cladding). The coating is disclosed as any metal alloy having good thermal conduction properties with examples including aluminum-silicon and zinc-aluminum alloys. Japanese Patent Publication No. SHO 47-14200 discloses a fuel element in which one of two groups of pellets is coated with a layer of silicon carbide and the other group is coated with a layer of pyrocarbon or metal carbide.

The coating of a nuclear fuel material introduces reliability problems in that achieving uniform coatings free of faults is difficult. Further, the deterioration of the coating involves loss of performance of the nuclear fuel element.

U.S. patent application Ser. No. 330,152, filed Feb. 6, 1973 now abandoned, discloses a method for preventing failure of nuclear fuel cladding consisting of the addition of a metal such as niobium to the fuel. The additive can be in the form of a powder, provided the subsequent fuel processing operation does not oxidize the metal, or the additive can be incorporated into the fuel element as wires, sheets or other forms in, around, or between fuel pellets.

Document GEAP-4555, dated February, 1964, describes a composite cladding of a zirconium alloy with an inner lining of stainless steel metallurgically bonded to the zirconium alloy. The composite cladding is fabricated by extrusion of a hollow zirconium alloy billet having an inner lining of stainless steel. This cladding has the disadvantage that the stainless steel layer involves a neutron absorption penalty of about ten to fifteen times the penalty for a zirconium alloy layer of the same thickness.

U.S. Pat. No. 3,502,549 discloses a method of protecting zirconium and its alloys by the electrolytic deposition of chromium thereon to provide a composite material useful for nuclear reactors. A method for electrolytic deposition of copper on Zircaloy-2 surfaces and subsequent heat treatment for the purpose of obtaining diffusion of the copper into the plated Zircaloy-2 surface is disclosed in *Energia Nucleare,* Volume 11, number 9 (September 1964) at pages 505–508.

*Stability and Compatibility of Hydrogen Barriers Applied to Zirconium Alloys,* by F. Brossa et al (European Atomic Energy Community, Joint Nuclear Research Center, EUR 4098e 1969), describes methods of deposition of different coatings on zirconium alloys and the efficiency of these coatings as hydrogen diffusion barriers. An Al-Si coating is stated to be the most promising barrier against hydrogen diffusion.

Methods for electroplating nickel on zirconium and zirconium tin alloys and heat treating these alloys to produce alloy-diffusion bonds are disclosed in *Electroplating on Zirconium and Zirconium-Tin,* by W. C. Schickner et al (BM1-757, Technical Information Service, 1952). U.S. Pat. No. 3,625,821 discloses a fuel element in which the cladding tube is coated on its inner surface with a burnable poison retaining metal of low neutron capture cross section such as nickel and having finely dispersed particles of a burnable poison retained therein.

*Reactor Development Program Progress Report* of August, 1973 (ANL-RDP-19) discloses a sacrificial layer of chromium as a chemical getter arranged on the inner surface of a stainless steel cladding.

Another approach to provide cladding protection has been to introduce a barrier between the nuclear fuel material and the cladding, as disclosed in U.S. Pat. No. 3,230,150 (copper foil), German Patent Publication DAS No. 1,238,115 (titanium layer), U.S. Pat. No. 3,212,988 (sheath of zirconium, aluminum or beryllium), U.S. Pat. No. 3,018,238 (barrier of crystalline carbon between the $UO_2$ and the zirconium cladding, and U.S. Pat. No. 3,088,893 (stainless steel foil). While the barrier concept proves promising, some of the foregoing references involve materials which are incompatible with the nuclear fuel (e.g., carbon can combine with oxygen from the nuclear fuel).

Other fuel clad barrier concepts are disclosed in U.S. Pat. No. 3,969,186 (refractory metal such as molybdenum, tungsten, rhenium, niobium and alloys thereof in the form of a tube or foil of single or multiple layers or a coating on the internal surface of the cladding), and U.S. Pat. No. 3,925,151 (liner of zirconium, niobium or alloys thereof between the nuclear fuel and the cladding with a coating of a high lubricity material between the liner and the cladding).

Another fuel clad barrier for protecting the zirconium or zirconium alloy cladding container is shown in the Gordon, et al U.S. Pat. No. 4,029,545 assigned to the same assignee as the present invention. In that patent, a layer such as chromium is electroplated onto a zirconium or zirconium alloy substrate, followed by the electroplating of a metal layer selected from copper, nickel or iron onto the chromium layer. However, it has been found to be uneconomical to electroplate the zirconium or zirconium alloy cladding with chromium thus rendering this patent less promising than originally anticipated. An alternative procedure is shown by Gordon et al in U.S. Pat. No. 4,022,662 in which a zircaloy material encloses a free standing metal tube comprised of either stainless steel, copper or copper alloys or nickel or nickel alloys that in turn encloses the core of nuclear fuel material. A diffusion barrier comprised of a chromium coating is coated on either the inside surface of the cladding or on the outside surface of the metal tube. Again, the Gordon et al nuclear fuel element is uneconomical because chromium electrodeposition is required and a separate copper tube has to be fabricated. Therefore it is still desirable to achieve an economic solution of the problem of preventing perforations or failures in nuclear fuel cladding resulting from metal embrittlement or stress corrosion cracking involving fuel pelletcladding interaction.

One very successful approach is disclosed in U.S. patent application Ser. No. 820,797, filed Aug. 1, 1977 in the names of William T. Grubb and Lawrence H. King entitled "Nuclear Fuel Element Having a Composite Coating" and assigned to the same assignee as the present invention, and now abandoned in favor of continuation-in-part application Ser. No. 087,547, filed Oct. 22, 1979. The nuclear fuel element consists of a core of nuclear fuel material enclosed in zirconium or zirconium alloy container, the inside surface of which is coated first with an intermediate zirconium oxide diffusion barrier layer and then with a metal selected from the group consisting of copper, nickel or iron. This patent application of Grubb, et al also discloses a method of making such a container comprising the steps of:

(A) etching or roughening the inner surface of the zirconium or zirconium alloy container, (B) oxidizing the etched or roughened surface to produce a zirconium oxide coating, (C) activating the zirconium oxide coating by contacting the coating with salts of tin or various noble and precious metals to permit the metallic coating of such surface by electroless deposition, and (D) further coating the activated zirconium oxide layer with a metal.

SUMMARY OF THE INVENTION

The present invention is based on the discovery of an improved method for making a composite zirconium or zirconium alloy container for nuclear fuel material in a nuclear fuel element. This method comprises the steps of:

(a) etching the inner surface of the zirconium or zirconium alloy container, (b) desmutting the etched inner surface to remove only the loosely adhering material (smut), (c) oxidizing the desmutted inner surface to produce a zirconium oxide coating thereon, (d) contacting the zirconium oxide coated surface with an agitated aqueous alkaline cleaning solution to form a cleaned zirconium oxide surface, (e) activating the zirconium oxide coated surface by contacting the surface with salts of tin or various noble and precious metals to permit the metallic coating of the surface by electroless deposition, and (f) contacting the activated zirconium oxide coated surface with an electroless metal plating solution to deposit a metal layer on the inner surface of the container.

Each of the foregoing steps is followed by a rinse, preferably in deionized water, to provide a surface substantially free of any contaimination for the following step.

The desmutting step can be accomplished mechanically, such as by passing an absorbent swab across the inner surface of the container. It can also be done ultrasonically by immersing the container in a liquid, such as deionized water, and applying ultrasonic energy to the container.

The activating step can be performed by contacting the zirconium oxide surface with a solution containing salts of tin or various noble and precious metals.

The oxidizing step can be performed by autoclaving the container in steam at an elevated temperature (e.g., 350°-450° C. at 1 to 3 atmospheres for 5 to 50 hours).

REFERENCE TO THE DRAWING

The FIGURE is a block diagram of the process of this invention showing the sequence of steps performed.

DESCRIPTION OF THE INVENTION AND THE DRAWING

In the practice of this invention, a zirconium or zirconium alloy container, referred to hereinafter as the zirconium container, is converted to a composite cladding consisting of the zirconium container coated first on its inside surface with an intermediate zirconium oxide boundary layer and then with a metal layer selected from the group consisting of copper, copper alloys, nickel or iron.

The process will now be described in detail as set forth in the accompanying figure showing the sequence of steps.

If the zirconium container is not cleaned, it is initially cleaned with a detergent, exposed to a bright dip solution (such as a nitric acid-hydrofluoric acid solution) and then rinsed in deionized water.

The next step is etching the inside surface of the zirconium container. A preferred etchant is shown by U.S. Pat. No. 4,017,368 in the names of Daniel E. Wax and Robert L. Cowan, and assigned to the same assignee as the present invention. A typical etching procedure is to contact the zirconium container with an aged aqueous activating solution comprising from about 10 to about 20 grams per liter of ammonium bifluoride and from about 0.75 to about 2.0 grams per liter of sulfuric acid. The solution can be aged by immersion of a piece of zirconium having an area of 100 square centimeters per liter of solution, for about 10 minutes.

The zirconium container is rinsed, preferably using deionized water, to free the container of any residual traces of the etching solution.

The next step is removing any loosely adhering film (i.e., desmutting the "smut") formed on the inside surface of the container in the activating step. The desmutting can be accomplished by swabbing the inside surface of the container with a swab of organic absorbent material such as cotton, nylon or polyester. The organic swab can be wrapped around a rubber plug approximately the same size as the internal diameter of the container and forced through the container by gas pressure.

Desmutting of the continer can also be accomplished ultrasonically, i.e., by submerging the container in water and applying ultrasonic energy in the range of about 20,000 to about 300,000 Hertz (cycles per second). This is continued for a time of about 1 to 2 minutes or more, or until visual observation shows that no more film is being removed. Below about 20,000 Hertz, the rate of desmutting is too slow, and the equipment for operation above about 300,000 Hertz involves added expense.

The container at this stage of the process has a dark adherent electrically conducting surface film or layer of zirconium compounds suitable for the subsequent steps of this method.

Next the zirconium container is rinsed, preferably using deionized water, to free the container of material from the desmutting step.

The next step is oxidation of the inside surface of the container by treating it with steam at a temperature of from about 350°–450° C. under a pressure of about 1 to about 3 atmospheres for a period of from 5 to 50 hours.

The zirconium container is then rinsed, preferably using deionized water.

Next the oxidized inner surface of the container is cleaned to remove substantially all foreign matter thereon by contacting the surface with an aqueous alkaline cleaning solution. Suitable solutions are sodium hydroxide, trisodium phosphate, sodium laural sulfate and mixtures of any two or more of the foregoing materials dissolved in water. A particularly preferred aqueous solution comprises from about 10 to about 300 grams per liter of sodium hydroxide, preferably in deionized water. Another preferred aqueous solution comprises from about 16 to about 64 grams per liter of ICC-1469, a proprietary alkaline cleaner sold by International Chemical Company.

The zirconium container is then rinsed, preferably using deionized water.

The next step in the process is activation of the oxidized surface of the container. This is achieved by contacting the container surface with an alkaline solution of salts of tin and salts of various noble and precious metals and combinations thereof. A preferred combination is an alkaline solution of stannous tin (such as sodium stannite) and palladium chloride. However, other noble metal salts can be used, such as platinum chloride, as well as precious metal salts such as silver chloride and gold chloride and alkaline solutions of precious metals, such as sodium aurate, sodium pallate, sodium platinate. In one preferred practice of this invention, the oxidized zirconium surface is treated with a Cuposit Catalyst 9F solution, a product of the Shipley Company of Newton, Mass. The treated zirconium oxide surface can then be rinsed further with water and treated with Cuposit Accelerator 19A, also a product of the Shipley Company.

The zirconium container is then rinsed, preferably using deionized water, to remove the activation solution from the container.

Next the electroless plating of the activated zirconium oxide coated zirconium container can be achieved by standard procedures, such as by allowing the plating solution to flow uniformly through the container over the inside surface to achieve a uniform buildup of metal on this inside surface. Although copper and copper alloys are preferred, other metals such as nickel or iron also can be plated onto the surface of the zirconium oxide to achieve effective results.

For electroless copper plating, an aqueous bath of the following composition can be used: 141.5 grams of sodium potassium tartrate ($KNaC_4H_4O_6.4H_2O$), 41.5 grams of sodium hydroxide (NaOH), 29 grams of copper sulfate ($CuSO_4.5H_2O$) plus distilled water to make 1 liter. Immediately prior to use, 167 ml of a 73% aqueous formaldehyde solution ($H_2CO$) can be added to the bath. This is a version of the well known Fehling's copper plating bath. Other proprietary electroless copper plating formulations can be employed, such as those identified as MacDermid 9038, Shipley CP74 and Sel-Rex CU510. The plating bath is agitated or stirred prior to being passed uniformly over the article to be plated. Preferred plating temperatures are in the range of about 25° to about 75° C. This procedure produces a very good as-plated adherence with substantially no porosity.

In order to insure that the plated container can be used at elevated temperatures without any substantial loss of adhesion, the plated container is out-gassed in either argon or vacuum at a temperature of about 300° to about 400° F. (149° to 204° C.). In this out-gassing, the temperature is raised from ambient to the final temperature at a rate of about 50° F. to 122° F. (10° to 50° C.) per hour.

During the electroless plating of copper on the article, a considerable quantity of hydrogen gas is evolved. Hydrogen gas can interfere with the electroless plating process, since it has a tendency to adhere to the wall of the tube, and hydrogen removal is preferably facilitated by pumping the plating solution through the tube. In addition, such hydrogen interference can be reduced if the tube is electroless plated while in a vertical position.

For plating nickel on zirconium, an aqueous bath of the following composition is employed: 30 grams/liter of nickel chloride ($NiCl_2.6H_2O$), 10 grams/liter of sodium hypophosphite ($NaH_2PO_2.H_2O$), 12.6 grams/liter of sodium citrate ($Na_3C_6H_5O_7.2H_2O$), 5 grams/liter of sodium acetate ($NaC_2H_3O_2$) and sufficient sodium hydroxide (NaOH) to give a pH in the range of 4 to 6. Other proprietary electroless nickel plating formulations can be employed. The plating bath is agitated and passed uniformly over the article to be plated at a temperature of about 194° to about 212° F. (90° to 100° C.) with a preferred target temperature being 95°±2° C. This procedure produces a very good asplated adherence with no porosity. In order to insure that the plated article can be used at elevated temperatures without any substantial loss of adhesion, the same out-gassing procedure employed above for copper is used.

Similar well known iron electroless plating compositions can be used for plating iron on the inside surface of the zirconium container. The containers treated by the process of this invention can be zirconium material taken directly from milling operations or can be subjected to prior mechanical cleaning (e.g., grit blasting) or chemical cleaning (e.g., cleaned by acid and/or alkaline etching).

In order that those skilled in the art will be better able to practice the invention, the following examples are given by way of illustration and not by way of limitation.

EXAMPLE 1

A Zircaloy-2 tube 92 cm in length which had been rocked on a Pilger mill to 12.4 mm outer diameter and 10.7 mm inner diameter was rinsed in water then bright dipped in a solution comprised of 80 parts by volume nitric acid, 2 parts by volume hydrofluoric acid solution, and sufficient water to comprise 1 liter. The tube was then cleaned in 20% by weight deionized water solution of ICC-1469 Alkaline Cleaner (sold by International Chemical Company) using a 1200 watt ultrasonic cleaning tank. The tube was then rinsed with flowing deionized water for five minutes. Then an etching solution comprised of 15 grams ammonium bifluoride and 0.5 ml sulfuric acid in 1 liter of deionized water, is pumped through the tube at the rate of 1 liter/minute for 1 minute. Deionized water was then pumped through the tube at the rate of 2 liters/minute for 1 minute. The tube was desmutted by passing three cotton balls soaked in deionized water through the tube by use of compressed argon. The tube was rinsed for 5 minutes with deionized water. The tube was autoclaved at 400° C. in steam at 172,000 pascal (1.7 atmospheres) for 14 hours. When the tube was cool, it was removed from the autoclave and cleaned again in the same International Chemical Company ICC-1469 solution for 5 minutes in the ultrasonic cleaner, followed by a 5 minute rinse in deionized water.

The tube was then activated by initially pumping a solution of Cuposit Catalyst 9F (manufactured by the Shipley Company of Newton, Mass.) through the tube at a rate of 1 liter/minute for a period of 3 minutes, followed by a 3 minute rinse in deionized water. A solution of Cuposit Accelerator 19 was then pumped through the tube for 6 minutes at a rate of about 1 liter/minute followed by a 6 minute rinse in deionized water. The tube was then plated for 2 hours at 60° C. by pumping Metex #9038 plating bath, a commercial product manufactured by MacDermid Inc., of Waterford, Conn., through the tube. The plating bath was pumped through the sample tube at a rate of 1 liter/minute, and thermostatically controlled to a temperature of about 60° C. This yielded a composite cladding comprised of a Zircaloy-2 container coated on its inside surface with about 10 microns of copper and intermediate boundary layer of about 0.7 micron of zirconium oxide on the initial Zircaloy-2 substrate. This composite tube was then loaded using standard techniques with 10.6 mm (diameter)×10.4 mm (length) uranium oxide pellets to produce a nuclear fuel element suitable for use in the core of a nuclear reactor.

EXAMPLE 2

A Zircaloy-2 tube which had been rocked on a Pilger mill to 12.4 mm outer diameter and 10.7 mm inner diameter was rinsed in water and bright dipped in the same formulation of a nitric acid-hydrofluoric acid solution used in Example 1. The tube was then cleaned in the same formulation of a deionized water solution of ICC-1469 Alkaline Cleaner in the same ultrasonic cleaning tank. The tube was rinsed with flowing deionized water for five minutes. The tube was etched, while immersed in the ultrasonic tank, by pumping through the tube a solution comprised of 15 grams ammonium bifluoride and 0.5 ml sulfuric acid in 1 liter of deionized water. The etchant was pumped through the tube at 1 liter/minute for about 1 minute. The tube was removed from the ultrasonic tank and rinsed with deionized water for about 1 minute. The tube was autoclaved at 400° C. at 172,000 pascal (1.7 atmospheres) for 14 hours, was removed from the autoclave and cleaned again in ICC-1469 solution for 5 minutes in the ultrasonic cleaning tank. This was followed by a 5 minute rinse in deionized water.

The tube was activated by initially pumping through it a solution of Cuposit Catalyst 9F manufactured by the Shipley Company of Newton, Mass., at a rate of 1 liter/minute for a period of 3 minutes, and then rinsed with deionized water for 3 minutes. A solution of Cuposit Accelerator 19A was pumped through the tube for 6 minutes at a rate of about 1 liter/minute, followed by a 6 minute rinse of the tube with deionized water. The tube was then plated for 2 hours at 60° C. in Metex #9038 plating bath, a commercial product manufactured by MacDermid Inc., of Waterford, Conn. The plating bath was pumped through the sample tube at a rate of 1 liter/minute from a vessel having a thermostatic control. There resulted a composite Zircaloy-2 tube in which the Zircaloy has a coating of an intermediate boundary layer of about 0.7 microns zirconium oxide and then a layer of about 10 microns of copper.

What we claim as new and desire to secure by Letters Patent of the United States is:

1. A method for producing a zirconium or a zirconium alloy container for fissionable nuclear reactor fuel, which container is resistant to stress corrosion cracking and embrittlement when subjected to fission reactions in nuclear reactor use, which method comprises the steps of:

(a) etching the inside surface of said container,
(b) desmutting the etched surface of said container to remove only loosely adhering material,
(c) oxidizing the inside surface of said container with steam to produce a zirconium oxide coating thereon,
(d) cleaning the oxidized surface of said container to remove substantially all foreign matter therefrom,
(e) activating the oxidized surface of said container for electroless deposition of a metal layer thereon, and
(f) contacting the activated surface of said container with an electroless metal plating solution to deposit a metal layer thereon.

2. A method according to claim 1 in which the zirconium oxide is electroless plated with a metal selected from the group consisting of copper, nickel and iron.

3. A method according to claim 2 in which the zirconium oxide is electroless plated with copper.

4. A method according to claim 2 in which the zirconium oxide is electroless plated with nickel.

5. A method according to claim 2 in which the zirconium is electroless plated with iron.

6. A method according to claim 1 where the inside surface of the container is etched by treating it with an ammonium bifluoridesulfuric acid solution.

7. A method according to claim 1 in which the oxidizing step is achieved by heating said container at elevated temperatures while the inside surface is contacted by steam.

8. A method according to claim 1 in which the desmutting step is achieved mechanically by contacting the inner surface of the container with a cotton swab.

9. A method according to claim 1 in which the desmutting step is achieved ultrasonically by immersing the container in a liquid followed by applying ultrasonic energy to the container.

10. A method according to claim 9 in which the liquid is deionized water.

11. A method according to claim 1 in which the cleaning step is achieved by contacting the inner surface of the container with an agitated aqueous alkaline cleaning solution.

12. A method according to claim 11 in which the agitation is achieved by impinging ultrasonic energy on the container.

13. A method according to claim 1 in which the activation step is achieved by contacting the inside surface of said container with an aqueous solution containing palladium chloride.

14. A method according to claim 1 in which the activation step is followed by contacting the inside surface of said container with an aqueous solution of fluoboric acid and oxalic acid.

15. A method according to claim 1 in which the activation step is achieved by contacting the inside surface of said container with an aqueous solution of stannous chloride.

* * * * *